US010327550B2

(12) United States Patent
Held

(10) Patent No.: US 10,327,550 B2
(45) Date of Patent: Jun. 25, 2019

(54) DRAWER COMPRISING A BASE PANEL, A SCREEN, A REAR WALL AND TWO LATERAL WALLS WHICH ARE RIGIDLY INTERCONNECTED

(71) Applicant: FORM ORANGE PRODUKTENTWICKLUNG, Hard (AT)

(72) Inventor: Wolfgang Held, Hard (AT)

(73) Assignee: FORM ORANGE PRODUKTENTWICKLUNG, Hard (AT)

( * ) Notice: Subject to any disclaimer, the term of this patent is extended or adjusted under 35 U.S.C. 154(b) by 0 days.

(21) Appl. No.: 15/737,748

(22) PCT Filed: Jun. 30, 2016

(86) PCT No.: PCT/EP2016/065396

§ 371 (c)(1),
(2) Date: Dec. 18, 2017

(87) PCT Pub. No.: WO2017/001610

PCT Pub. Date: Jan. 5, 2017

(65) Prior Publication Data

US 2018/0177297 A1 Jun. 28, 2018

(30) Foreign Application Priority Data

Jul. 1, 2015 (AT) ..... 10 2015 110 561

(51) Int. Cl.
*A47B 88/956* (2017.01)
*A47B 88/931* (2017.01)
(Continued)

(52) U.S. Cl.
CPC ..... *A47B 88/956* (2017.01); *A47B 88/931* (2017.01); *A47B 88/941* (2017.01);
(Continued)

(58) Field of Classification Search
CPC ... A47B 88/956; A47B 88/941; A47B 88/931; A47B 2088/954; A47B 2088/902; A47B 2088/939; A47B 2088/94
See application file for complete search history.

(56) References Cited

U.S. PATENT DOCUMENTS 5,222,791 A * 6/1993 Held ..... A47B 88/00 312/348.4
5,525,002 A * 6/1996 Huber ..... A47B 88/00 403/261

(Continued)

FOREIGN PATENT DOCUMENTS

AT 506 783 A4 12/2009
WO WO 2012/092631 A1 7/2012

*Primary Examiner* — Hanh V Tran
(74) *Attorney, Agent, or Firm* — John Alumit

(57) ABSTRACT

A drawer having a bottom panel, a facing, a back wall, and two side walls that are firmly connected to one another. The side walls extend below a top edge of the facing and the back wall. The facing and the back wall are connected to one another in the vicinity of their upper edges by side wall profile segments that on their ends receive connection elements with housings that are attachable to the facing and the back wall. The connection element associated with the back wall is extractable to a limited extent in a sheath in the vicinity of the housing and can be screwed, adjacent to the sheath, into a threaded bore. The end of the connection element being embodied as a threaded bolt, so that the side wall profile segment is thus adjustable toward the facing or toward the back wall. The facing that is connected to the side wall profile segment through the connection element is also adjustable.

7 Claims, 6 Drawing Sheets

(51) Int. Cl.
*A47B 88/90* (2017.01)
*A47B 88/919* (2017.01)
*A47B 88/95* (2017.01)

(52) U.S. Cl.
CPC ... *A47B 2088/902* (2017.01); *A47B 2088/939* (2017.01); *A47B 2088/94* (2017.01); *A47B 2088/954* (2017.01)

(56) References Cited

U.S. PATENT DOCUMENTS

| | | | | | |
|---|---|---|---|---|---|
| 5,690,405 | A * | 11/1997 | Huber | A47B 88/00 | 312/348.2 |
| 6,120,226 | A * | 9/2000 | Egger | A47B 88/00 | 312/348.6 |
| 2011/0163647 | A1* | 7/2011 | Hartl | A47B 88/956 | 312/334.7 |
| 2012/0133259 | A1* | 5/2012 | Babucke-Runte | A47B 88/941 | 312/330.1 |
| 2012/0294555 | A1* | 11/2012 | Roeck | A47B 77/18 | 384/20 |
| 2013/0257251 | A1* | 10/2013 | Gasser | F16B 12/26 | 312/348.2 |
| 2013/0293079 | A1* | 11/2013 | Haemmerle | A47B 88/0422 | 312/334.8 |
| 2014/0117828 | A1* | 5/2014 | Gasser | A47B 88/0422 | 312/333 |
| 2014/0197724 | A1* | 7/2014 | Gasser | A47B 88/0014 | 312/330.1 |

* cited by examiner

DRAWER COMPRISING A BASE PANEL, A SCREEN, A REAR WALL AND TWO LATERAL WALLS WHICH ARE RIGIDLY INTERCONNECTED

A drawer having a bottom panel, a facing, a back wall, and two side walls that are firmly connected to one another.

There are also drawers in which the side walls do not extend as far as the upper edge of the facing and of the back wall. Often, the facings are connected to the face end of the side walls of the drawer via special fittings, which make it possible to orient the facing of the drawer with the aid of special fittings.

It is the object of the invention, in a drawer in which the side walls do not extend as far as the upper edge of the facing and of the back wall, to achieve a position of the facing by substantially simpler means.

The stated object is attained by the features of claim 1.

This is attained in that a drawer of the usual type, which has a bottom panel, a facing, a back wall, and two side walls that are firmly connected to one another, whereby the side walls extend below a top edge of the facing and the back wall, whereby the facing and the back wall are connected to one another in the vicinity of their upper edges by side wall profile segments that on their ends receive connection elements with housings that are insertable into side wall profile segments and that are connectable to the facing and the back wall. The connection element associated with the back wall is extractable to a limited extent in a sheath in the vicinity of the housing and can be screwed, adjacent to the sheath, into a threaded bore, whereby the end of the connection element being embodied as a threaded bolt, so that the side wall profile segment is thus adjustable toward the facing or toward the back wall, whereby the facing that is connected to the side wall profile segment through the connection element is also adjustable. In this way, via the connection elements of the side wall profile segments, the facing and the back wall of the drawer are connected to one another in such a way that the facing of the drawer can be oriented substantially more simply. Thus the expensive and complicated fittings between the facing and the face ends of the two side walls can be dispensed with.

Advantageous refinements of the drawer can be learned from the dependent claims.

The connection element associated with the facing is embodied as a rotatable connection peg with a detent shoulder that can be unscrewed from the side wall profile segment, that connection peg being insertable into a bore in the facing side of the facing and being latchable with the unscrewed detent shoulder into a detent receptacle on the back side of the facing.

The connection element associated with the facing protrudes on a face end of the side wall profile segment by an amount which is less than the thickness of the facing of the drawer and that the connection element closes the face end opening of the side wall profile segment.

The side wall profile segment has a recess for the unscrewable detent shoulder.

The recess has an edge which defines the unscrewed final position of the detent shoulder and thus determines the maximum angle of the oblique position of the side wall profile segment relative to the facing.

In the housing of the connecting element associated with the facing additionally a fold-out cover is provided, which covers the recess in the side wall profile segment.

The housing of the connection element associated with the back wall is flush with the face end of the side wall profile segment and is provided with firmly protruding detent shoulders, which are latched in detent receptacles on the side facing them of the back wall.

The detent shoulders are integrally formed with the housing.

The invention will be described in further detail in conjunction with the accompanying drawings in terms of an exemplary embodiment of a drawer according to the invention. In drawings.

Figure 4:
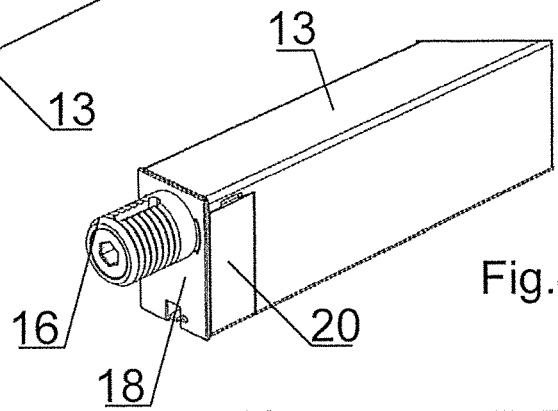
Figure 5:
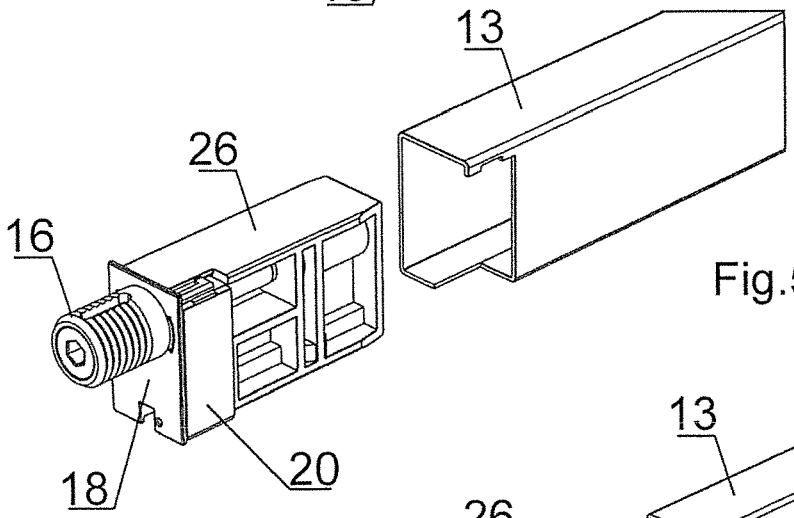
Figure 6:
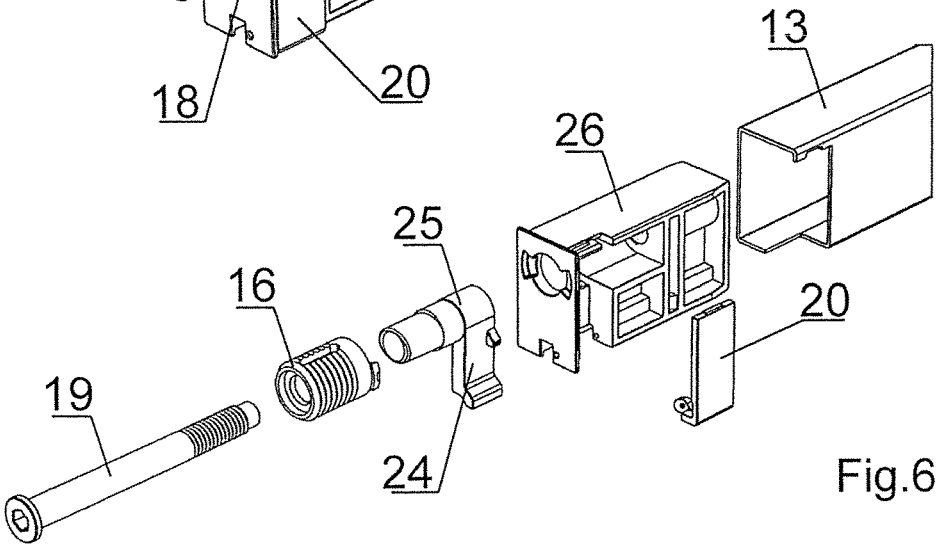
Figure 7:
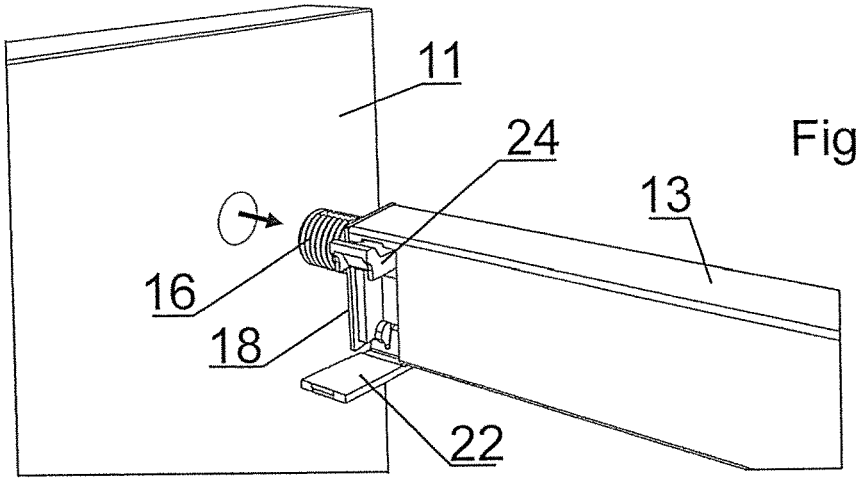
Figure 8:
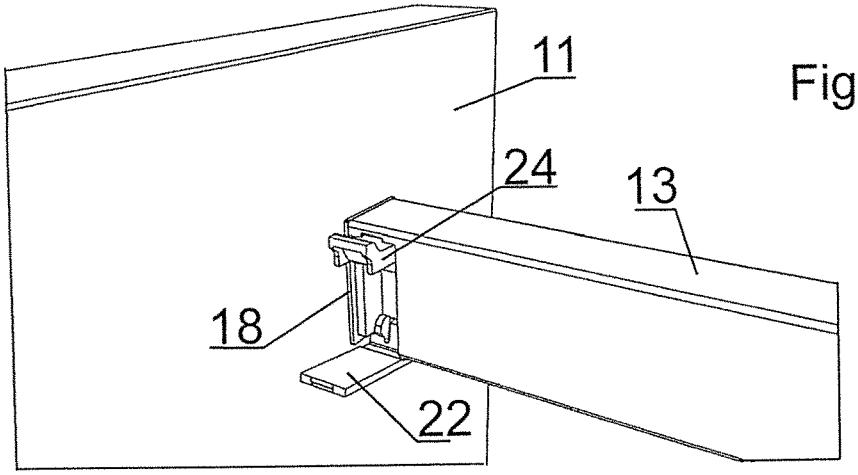
Figure 9:
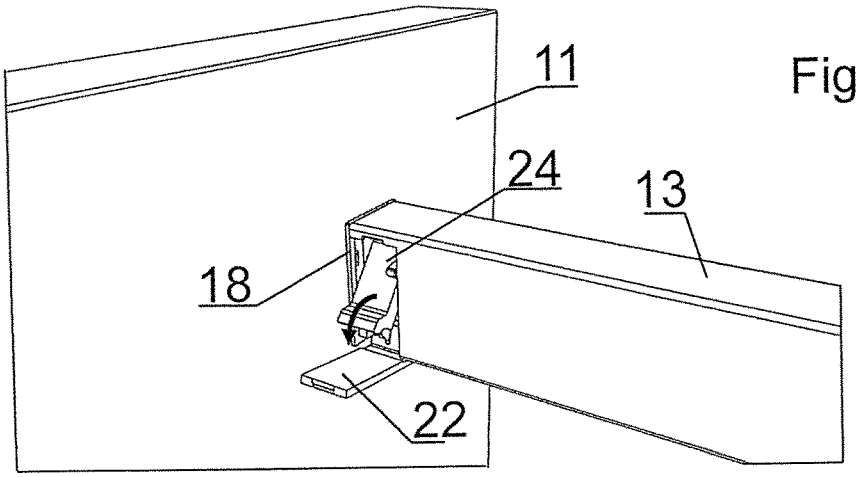
Figure 10:
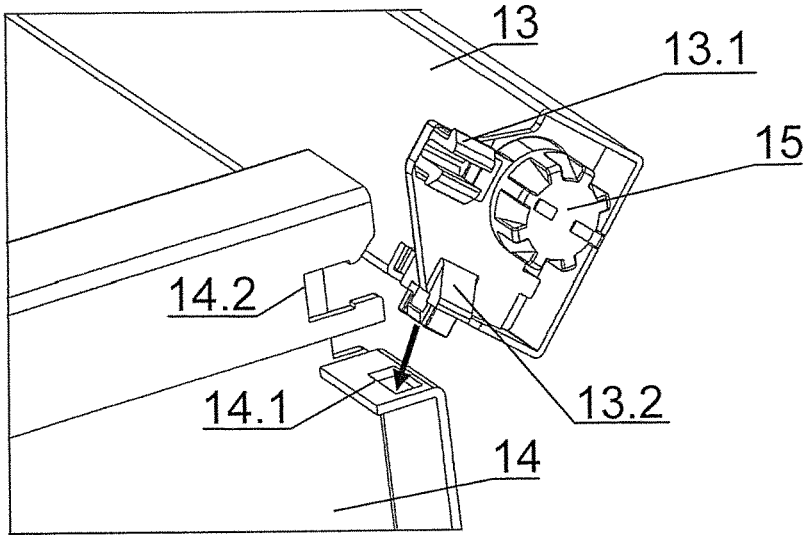
Figure 11:
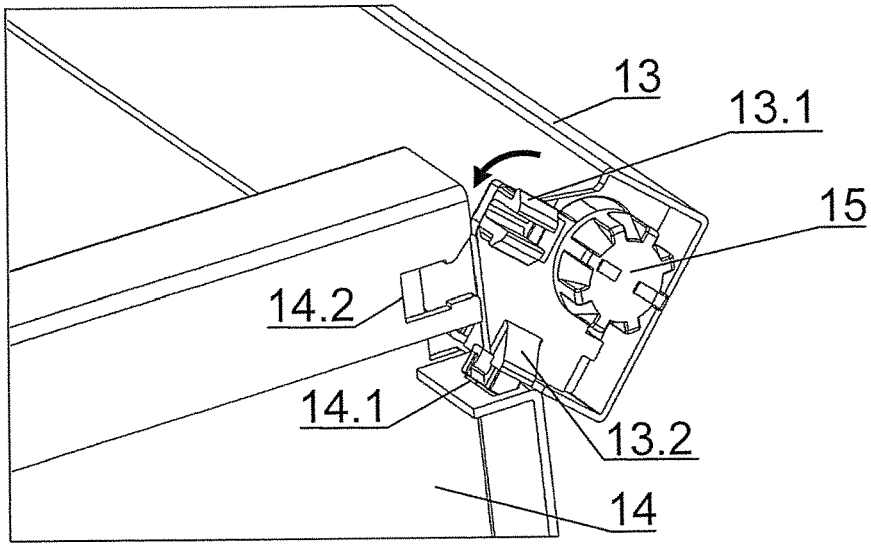
Figure 12:
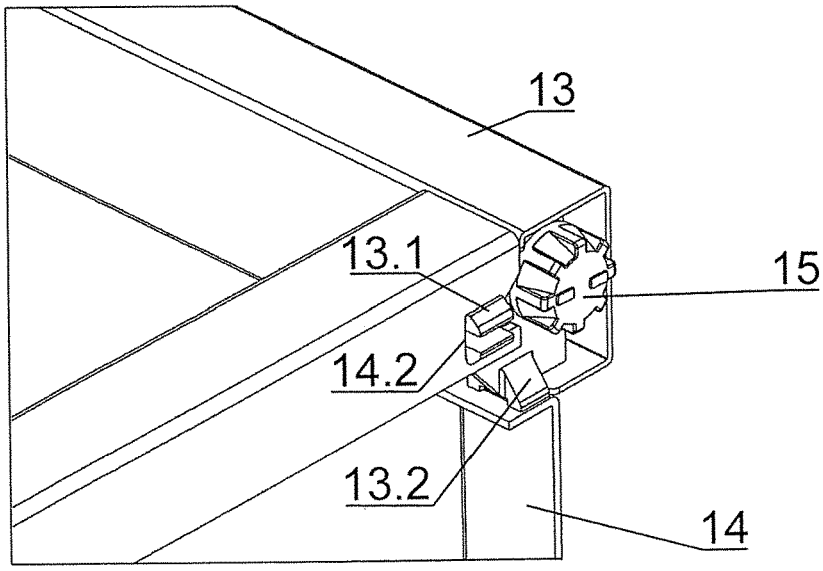
Figure 19:
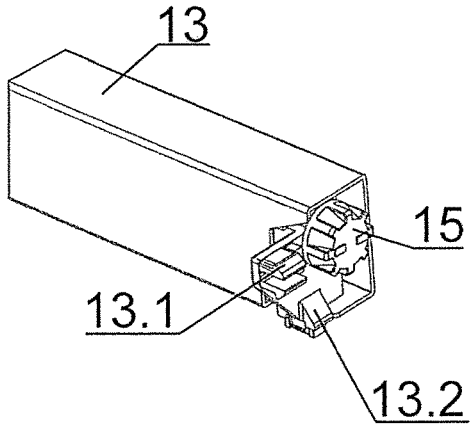
Figure 18:
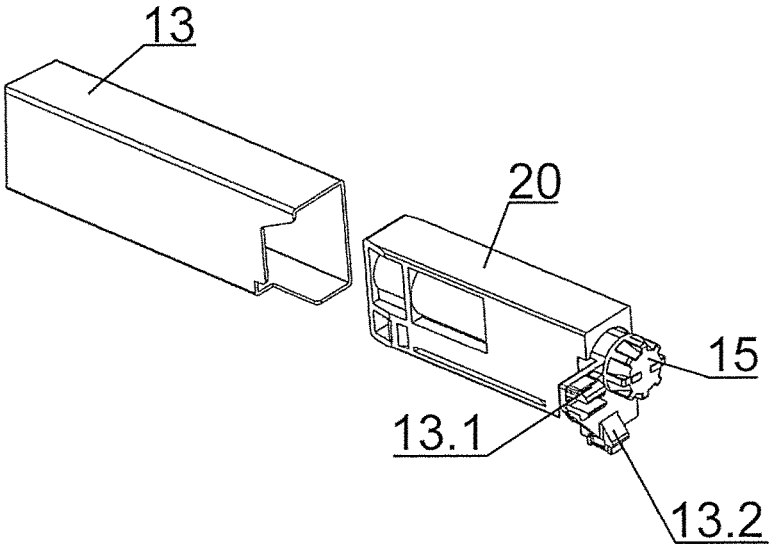
Figure 17:
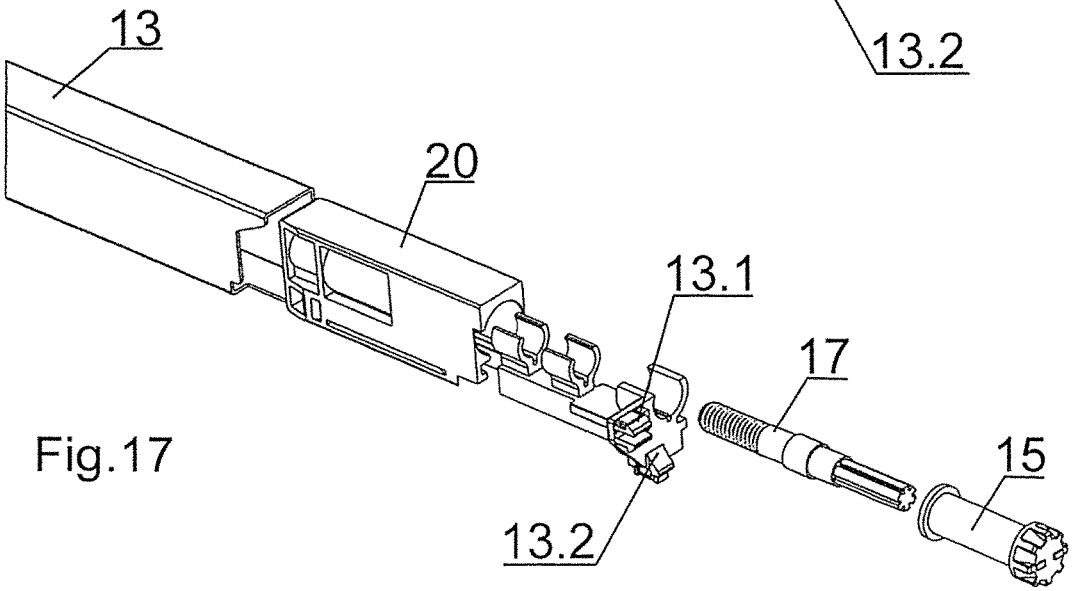

FIGS. 4-6 show the connection element 16, oriented toward the back side of the facing 11, which connection element is insertable with a housing 26 into the side wall profile segment 13 and can be fixed therein;

FIGS. 7-9 show the connection between the facing and the side wall profile segment in various positions;

FIGS. 10-12 show the connection between the side wall profile segment and the back wall in the various positions;

FIGS. 13-16 show the side wall profile segment connected with the wall in various positions relative to the facing or to the back wall;

FIGS. 17-19 show the connection element 15 between the side wall profile segment 13 and the back wall 14 in various positions.

Figure 1:
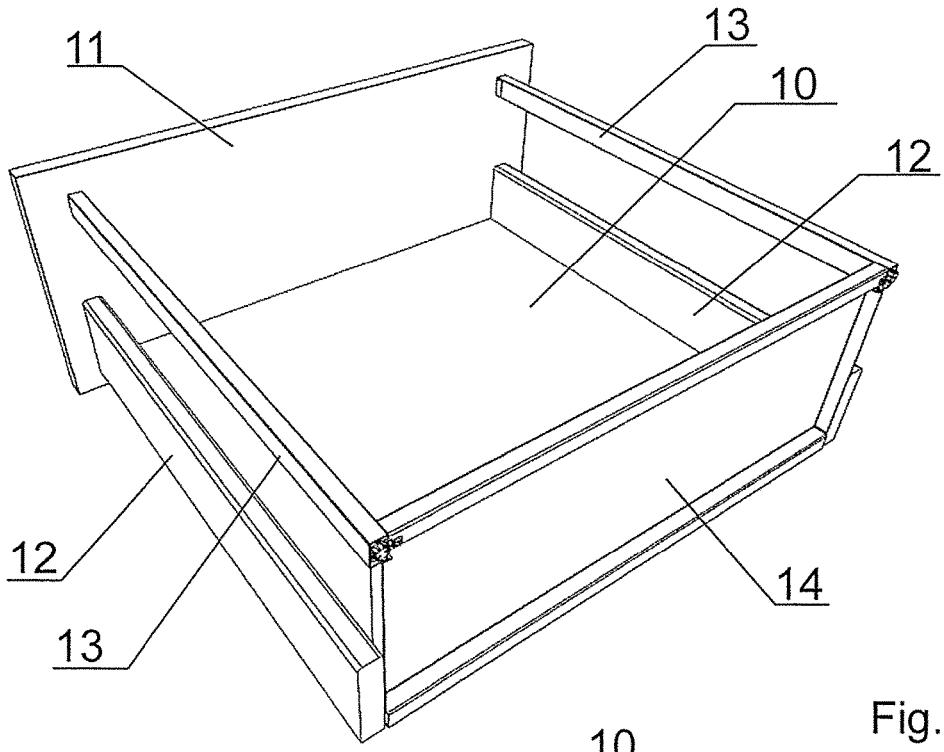
FIG. 1 shows the basic construction of the drawer of the invention in perspective, seen from the back side of the drawer.

FIG. 1 shows the basic construction of a drawer of the invention in a perspective view, seen from the back side of the drawer. The drawer comprises a bottom panel 10, a facing 11, a back wall 14 on the free rear end of the bottom panel 10, and two side walls 12, which, however, do not extend as far as the upper edges of the facing 11 and of the back wall 14. Thus there is enough room to connect the facing 11 and the back wall 14 firmly to one another via two side wall profile segments 13. That purpose is served by a connection element 16, on the side of the facing 11, and a connection element 15, on the side of the back wall 14, which are located at the ends of the side wall profile segment 13, as FIG. 3 shows.

Figure 2:
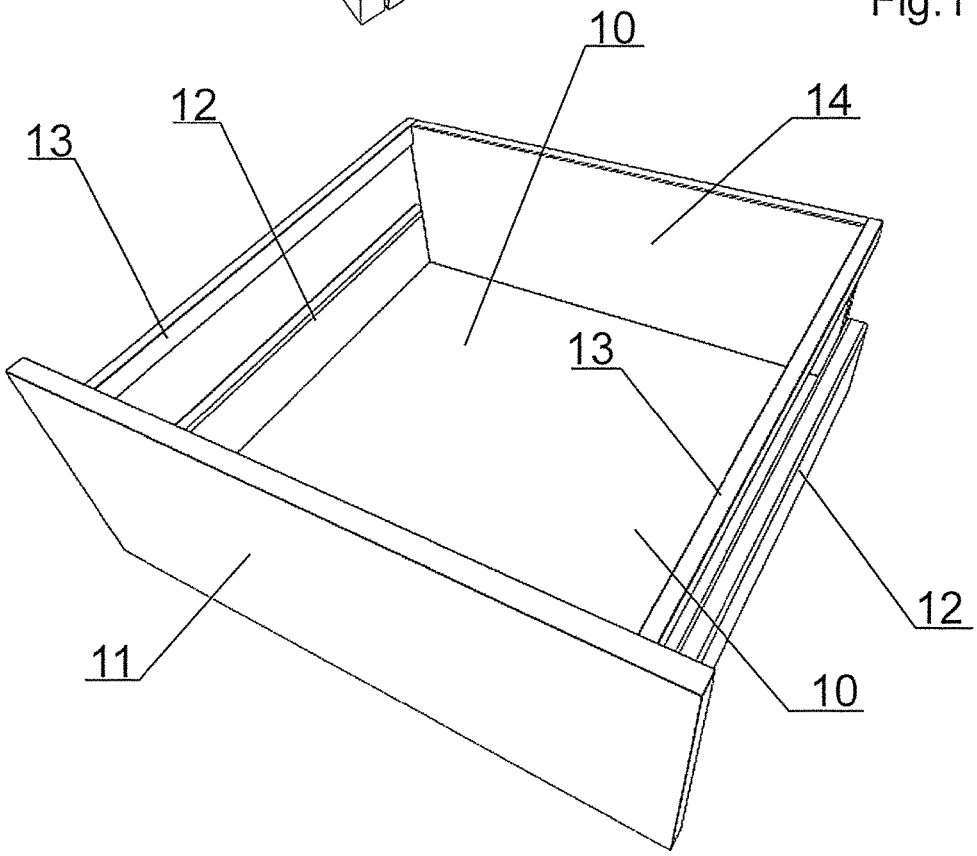
FIG. 2 shows the basic construction of the drawer of FIG. 1 in perspective, seen from the facing.

FIG. 2 shows the basic construction of the drawer of FIG. 1 in perspective, seen from the facing 11.

Figure 3:
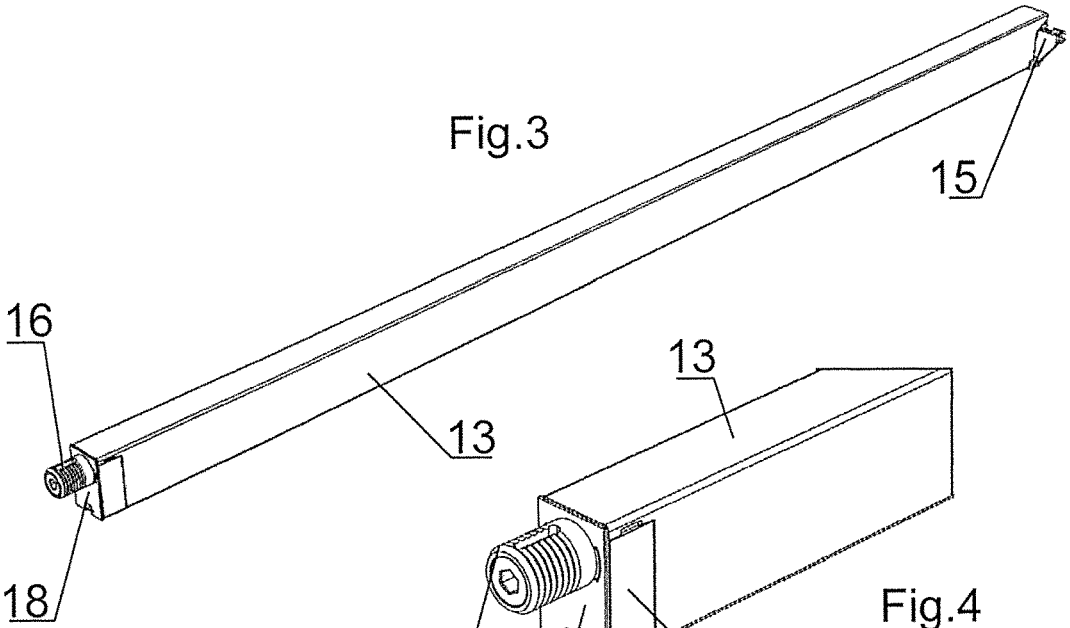
FIG. 3 shows the end, oriented toward the facing and the back wall, of a side wall profile segment with a connection element 16, and also shows the connection element 15 associated, by a region of the back wall, with the end of the side wall profile segment.

As FIG. 3 shows, the connection element 16 protrudes in the form of a bolt from the face end 18 of the side wall profile segment 13 by an amount which is less than the thickness of the facing 11. If a bore of appropriate depth is made in the back side of the facing 11, then the connection element 16 can be inserted and thus connected to the facing 11. The connection element 16 is rotatably supported in a housing 26 that has a recess oriented toward the back side of the facing 11. By rotating the connection element 16, a detent shoulder 24 in the housing 26 is rotated and unscrewed via a recess in the side wall profile segment 13 and screwed into a detent receptacle on the back side, oriented toward it, of the facing 11 and latched. Thus the side wall profile segment 13 with the closed face end 18 of the housing of the connection element 16 can be firmly connected flush with the back side of the facing 11 and adjusted into various angular positions of the facing 11. The recess in the side wall profile segment 13 has a stop edge, which limits the rotary motion of the detent shoulder 24 and thus limits the adjustment of the detent shoulder into the detent receptacle on the back side of the facing 11. The connection element 16 is rotatably supported in the housing.

In FIGS. 4 through 6, the connection element 16 with a housing 26 is shown, which can be inserted into the side wall profile segment 13. The housing 26 can be provided with detent cams, which latch in bores of the side wall profile segment 13 and fix the connection element 16 therein. The bolt-like connecting element 16 protrudes on the closed face end 18 of the housing 26 by an amount that fits into a space around which the side wall profile section 13 is set back relative to the plane of the side wall 12 of the drawer. The connection element 16 is provided with a threaded bolt 19 at the end and is screwed into a threaded bore in the housing 26. Furthermore, after this screw connection is loosened, the connection element 16 can be pulled to a limited extent out of the sheath in the housing 26. With a panel, the housing 26 closes the face end opening of the side wall profile segment 13. Detent shoulders are firmly formed onto the housing 26; they protrude from the housing 26 and latch into detent receptacles, on the side oriented toward them, of the back wall 14 of the drawer. In the vicinity of the detent shoulders, the side wall profile segment 13 therefore has a corresponding recess, out of which the detent shoulders are guided out of the side wall profile segment 13. Furthermore, a cover 22 can be folded out in the housing 26 that is supported on the side wall profile segment 13 and covers the recess in the side wall profile segment 13.

With this connection element 16, the side wall profile segment 13 can be adjusted into a position which is transferred via the connecting element 16 to the facing 11 of the drawer. In this way, by a substantially simpler means, the drawer facing position can be evened out. Furthermore, the connection element 16 always remains accessible, so that a change in the facing position is possible at any time.

FIGS. 7 through 9 show the various positions of the connection between the side wall profile segment 13 and the back side of the facing 11; above, the detent shoulder 24 that can be unscrewed and the fold out cover 22 that covers this detent shoulder 24 are shown.

FIG. 10 shows the installed position of the side wall profile segment 13 relative to the back wall 14. The connection screw 15, as can be seen from FIG. 17, is also introduced into a housing 20. The face end of the housing 20 has offset detent shoulders 13.1 and 13.2; the detent shoulder 13.2 can be introduced into the detent receptacle 14.1 of the back wall 14. Then, the side wall profile segment 13 is rotated, as FIG. 11 shows, and the detent shoulder 13.1 is introduced into the detent receptacle 14.2 of the back wall 14 and latched. In FIG. 12, the connection of the side wall profile segment 13 to the back wall 14 is shown.

Figure 13:
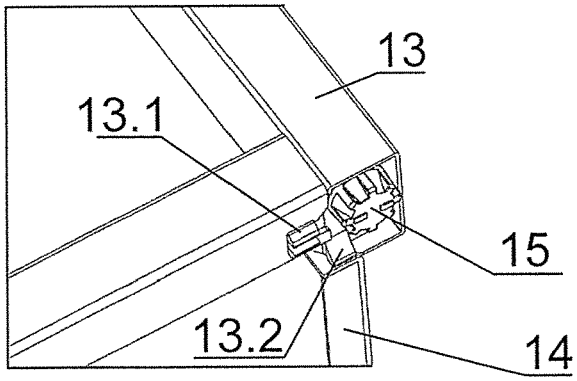
Figure 14:
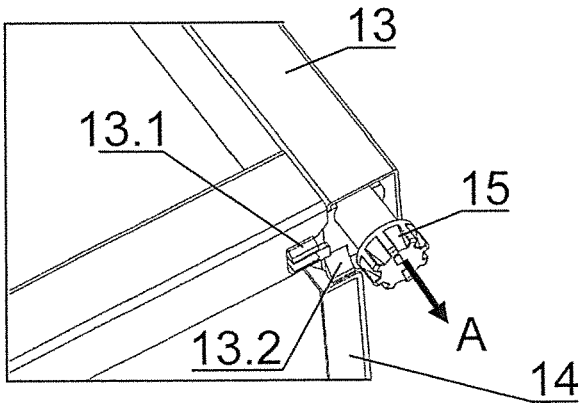
Figure 15:
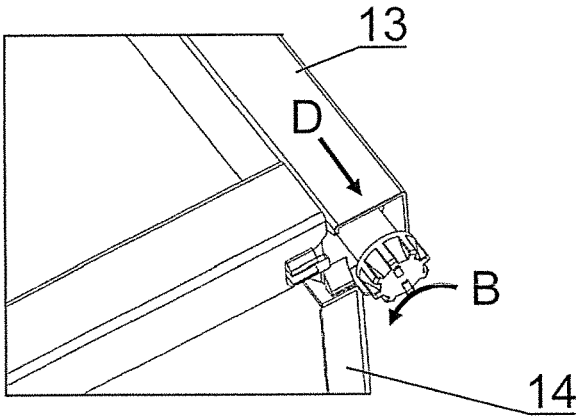

From the flush basic setting of FIG. 13, the connection element 15 can be adjusted to a pull-out position A, in which the side wall profile segment 13 is adjusted in the direction toward the back wall 14, as FIG. 14 shows. By rotating the connection element 15 in the direction B, the adjustment toward the back wall 14 can be increased still further, which the arrow D in FIG. 15 indicates.

Figure 16:
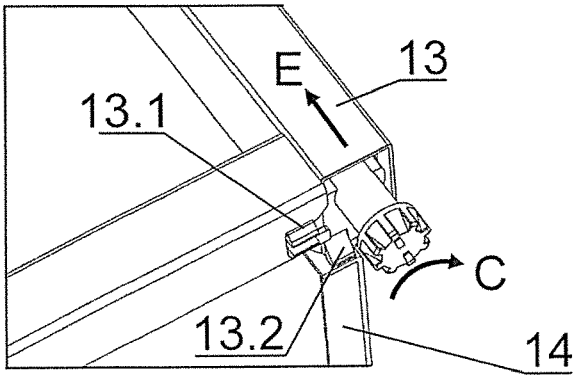

If the direction of rotation at the connection element 15 is reversed, as FIG. 16 shows, then the side wall profile segment 13 is adjusted in the direction E toward the facing. Since the facing 11 is firmly connected to the side wall profile segment 13, the adjustment is transferred in the same way to the facing 11.

As FIG. 17 shows, the connection element 15 is supported on an adjusting bolt 17 and introduced into a housing 20 and can be screwed into a threaded receptacle [in the housing 20. The detent elements 13.1 and 13.2 are integrally formed onto the housing 20. The housing 20 is inserted into the side wall profile segment 13 and retained there. By means of the rotary motion at the connection element 15, the adjustment can be made toward the facing 11, or toward the back wall 14. The detent shoulders 13.1 and 13.2 are fixed in the detent receptacles 14.1 and 14.2 of the back wall 14, as can already be seen from FIGS. 14 through 16.

The invention claimed is:

1. A drawer having a bottom panel (10), a facing (11), a back wall (14), and two side walls (12) that are firmly connected to one another, whereby the side walls (12) extend below a top edge of the facing (11) and of the back wall (14), and whereby the facing (11) and the back wall (14) are connected to one another in the vicinity of their upper edges by side wall profile segments (13) that on their ends receive connection elements (15, 16) with housings (26,20) that are insertable into the side wall profile segments (13) and that are connectable to the facing (11) and the back wall;

WHEREIN, one connection element (15) is associated with the back wall (14) and is extractable to a limited extent in a sheath in the vicinity of the housing (20) and can be screwed, adjacent to the sheath, into a threaded bore, WHEREIN the end of said connection element (15) is embodied as a threaded bolt (17) so that the side wall profile segment (13) is thus adjustable toward back wall (14), and WHEREIN the facing (11) that is connected to a side wall profile segment (13) through the connection element (16) is also adjustable.

2. The drawer of claim 1, wherein the connection element (16) associated with the facing (11) is embodied as a rotatable connection peg (16) with a detent shoulder (24) that can be unscrewed from the side wall profile segment (13) and that the connection peg (16) being insertable into a bore in the facing side of the facing (11) and being latchable with the unscrewed détente shoulder (24) into a detent receptacle on the back side of the facing (11).

3. The drawer of claim 2, wherein the side wall profile segment (13) has a recess for detent shoulder (12), said detent shoulder being unscrewable.

4. The drawer of claim 3, wherein the recess has an edge that defines an unscrewed final position of the detent shoulder (24) and thus determines the maximum angle of an oblique position of the side wall profile segment (13) relative to the facing (11).

5. The drawer of claim 3, wherein the housing (26) that is insertable into the side wall profile segment (13) and is connectable to the facing, further comprises a fold-out cover (22) which covers the recess in the side wall profile segment (13).

6. The drawer of claim 1, wherein the housing (20) that is insertable into side wall profile segment (13) and that is connectable to the back wall (14) is flush with a face end of the side wall profile segment (13) and is firmly provided with detent shoulders (13.1, 13.2) that are latched in detent receptacles (14.1, 14.2) of the back wall (14), on a side of the backwall facing said wall profile segment (13).

7. The drawer of claim 6, wherein the detent shoulders (13.1, 13.2) are integrally formed with the housing.

* * * * *